US010539388B2

(12) United States Patent
Shaffer et al.

(10) Patent No.: US 10,539,388 B2
(45) **Date of Patent: *Jan. 21, 2020**

(54) INTERCHANGEABLE CROSSBOW COCKING SYSTEM

(71) Applicant: Hunter's Manufacturing Company, Inc., Suffield, OH (US)

(72) Inventors: Michael Shaffer, Mogadore, OH (US); Eric VanKeulen, North Canton, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/199,706

(22) Filed: Nov. 26, 2018

(65) Prior Publication Data

US 2019/0093979 A1 Mar. 28, 2019

Related U.S. Application Data

(63) Continuation of application No. 15/688,261, filed on Aug. 28, 2017, now Pat. No. 10,139,188.

(60) Provisional application No. 62/380,598, filed on Aug. 29, 2016.

(51) Int. Cl.
*F41B 5/12* (2006.01)

(52) U.S. Cl.
CPC ..... *F41B 5/12* (2013.01)

(58) Field of Classification Search
CPC ..... F41B 5/12
See application file for complete search history.

(56) References Cited

U.S. PATENT DOCUMENTS

| | | | |
|---|---|---|---|
| 2,092,361 | A | 9/1937 | Shim |
| 3,043,287 | A | 7/1962 | Nelson |
| 3,561,419 | A | 2/1971 | Cucuzza, Sr. |
| 3,670,711 | A | 6/1972 | Firestone |
| 3,739,765 | A | 6/1973 | Moore |
| 4,192,281 | A | 3/1980 | King |
| 4,246,883 | A | 1/1981 | Ash |
| 4,593,675 | A | 6/1986 | Waiser |
| 4,603,676 | A | 8/1986 | Luoma |
| 4,649,892 | A | 3/1987 | Bozek |
| 4,662,345 | A | 5/1987 | Stephens |
| 4,665,885 | A | 5/1987 | Glomski et al. |
| 4,719,897 | A | 1/1988 | Gaudreau |
| 4,721,092 | A | 1/1988 | Waiser |
| 4,942,861 | A | 7/1990 | Bozek |

(Continued)

OTHER PUBLICATIONS

A Guide to the Crossbow, by W.F. Paterson, published by the Society of Archer-Antiquaries, 1990.
European Crossbows, A Survey by Josef Alm, copyrighted by the Trustees of the Royal Armouries and the Arms and Armour Society, 1994.

(Continued)

*Primary Examiner* — John A Ricci
(74) *Attorney, Agent, or Firm* — Emerson Thompson Bennett, LLC

(57) ABSTRACT

Provided is a crossbow cocking system comprising a crossbow stock having a first side and a second side opposite the first side; a first receptacle extending through the stock from the first side of the stock to the second side of the stock; a first adapter plate adapted for selectable and operational engagement with the first receptacle; and a cocking device engaged with the first adapter plate, and extending through the first adapter plate.

20 Claims, 14 Drawing Sheets

(56) References Cited

U.S. PATENT DOCUMENTS

| | | | | |
|---|---|---|---|---|
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,624,725 | B1 | 12/2009 | Choma | |
| 7,784,453 | B1 | 8/2010 | Yehle | |
| 8,443,790 | B2 | 5/2013 | Pestrue | |
| 8,499,753 | B2 | 8/2013 | Bednar | |
| 10,139,188 | B2 * | 11/2018 | Shaffer | F41B 5/12 |
| 2006/0086346 | A1 | 4/2006 | Middleton | |
| 2010/0170488 | A1 | 1/2010 | Rasor et al. | |

OTHER PUBLICATIONS

The Book of the Crossbow, by Ralph Payne-Gallwey, published by Dover Publications, Inc. of New York, 1995.

* cited by examiner

INTERCHANGEABLE CROSSBOW COCKING SYSTEM

CROSS-REFERENCE TO RELATED APPLICATIONS

This application claims the benefit of U.S. patent application Ser. No. 15/688,261, filed Aug. 28, 2017, and U.S. Provisional Application No. 62/380,598, filed Aug. 29, 2016, the entirety of which are fully incorporated by reference herein.

I. BACKGROUND

The present subject matter is directed to crossbows. More specifically the present subject matter is directed to cocking device for a crossbow. Even more specifically, the present subject matter is directed to an interchangeable crossbow cocking system.

There are multiple technical challenges present in current crossbow cocking systems. These challenges include, but are not necessarily limited to, ease of interchangeability, operational quality, and cost.

The first technical challenge, operational quality, includes both safety and reliability. A crossbow cocking system operates to move a crossbow bowstring from the uncocked to the cocked position, the forces and energies involved can create substantial mechanical stress within the crossbow cocking system and within or among associated mechanically engaged components or assemblies. In order to provide safe and reliable operational quality it is desirable that the crossbow cocking system engage securely with the associated crossbow.

The second technical challenge is ease of interchangeability. It is desirable that the crossbow cocking system not only be easy to install and remove, but these installation and removal operations be simple to perform correctly and that these operations can be performed quickly.

Providing a crossbow cocking system that is cost-effective, with secure engagement that allows for interchangeability that is simple, easy, and quick remains desirable.

II. SUMMARY

In accordance with one aspect of the present subject matter provided is a crossbow cocking system comprising a crossbow stock having a first side and a second side opposite the first side; a first receptacle extending through the stock from the first side of the stock to the second side of the stock; a first adapter plate adapted for selectable and operational engagement with the first receptacle; and a cocking device engaged with the first adapter plate, and extending through the first adapter plate.

Still other benefits and advantages of the present subject matter will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein:

FIG. 1 is a perspective view of one embodiment of a crossbow.

FIG. 2*a* is a perspective view of one embodiment of a crossbow body.

FIG. 2*b* is a perspective view of one embodiment of a crossbow stock.

FIG. 2*c* is a perspective view of one embodiment of a crossbow stock.

FIG. 3*a* is a perspective view of a first embodiment of an adapter plate

FIG. 3*b* is a perspective view of a first embodiment of an adapter plate.

FIG. 3*c* is a perspective view of a first embodiment of an adapter plate.

FIG. 4*a* is a perspective view of a second embodiment of an adapter plate

FIG. 4*b* is a perspective view of a second embodiment of an adapter plate.

FIG. 4*c* is a perspective view of a second embodiment of an adapter plate.

FIG. 5*a* is a perspective view of a third embodiment of an adapter plate

FIG. 5*b* is a perspective view of a third embodiment of an adapter plate.

IV. DETAILED DESCRIPTION

Figure 1:
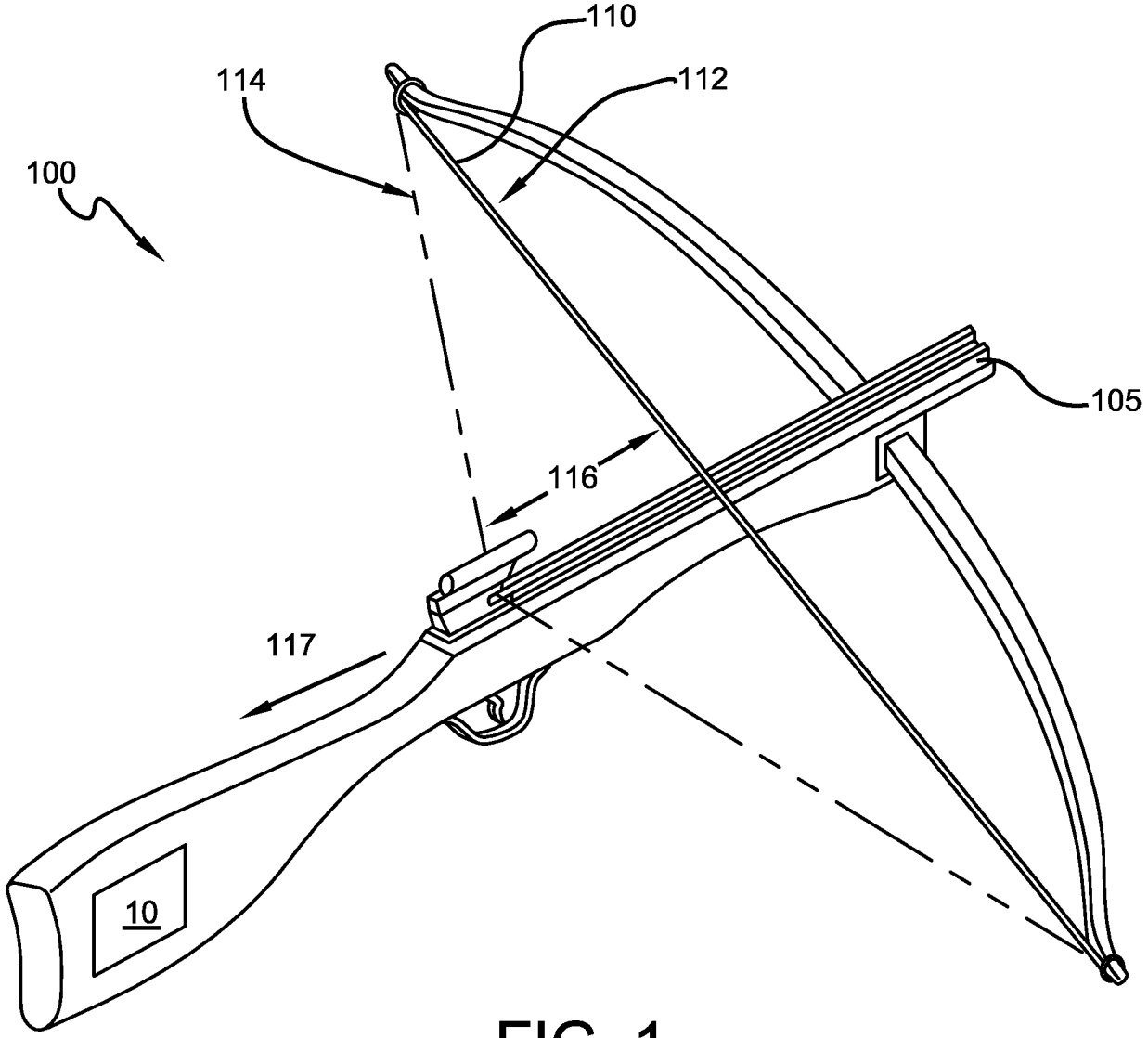

Referring now to the drawings wherein the showings are for purposes of illustrating embodiments of the present subject matter only and not for purposes of limiting the same, and wherein like reference numerals are understood to refer to like components, provided is a crossbow cocking system and a method for using same. It should be understood that some of the drawing figures comprise arrowheads and other superfluities. These superfluities are not intended to be limiting.

A crossbow cocking system 10 may comprise a crossbow stock 210, an adapter plate 300, 400, 500 and a cocking device 610.

Figure 2A:
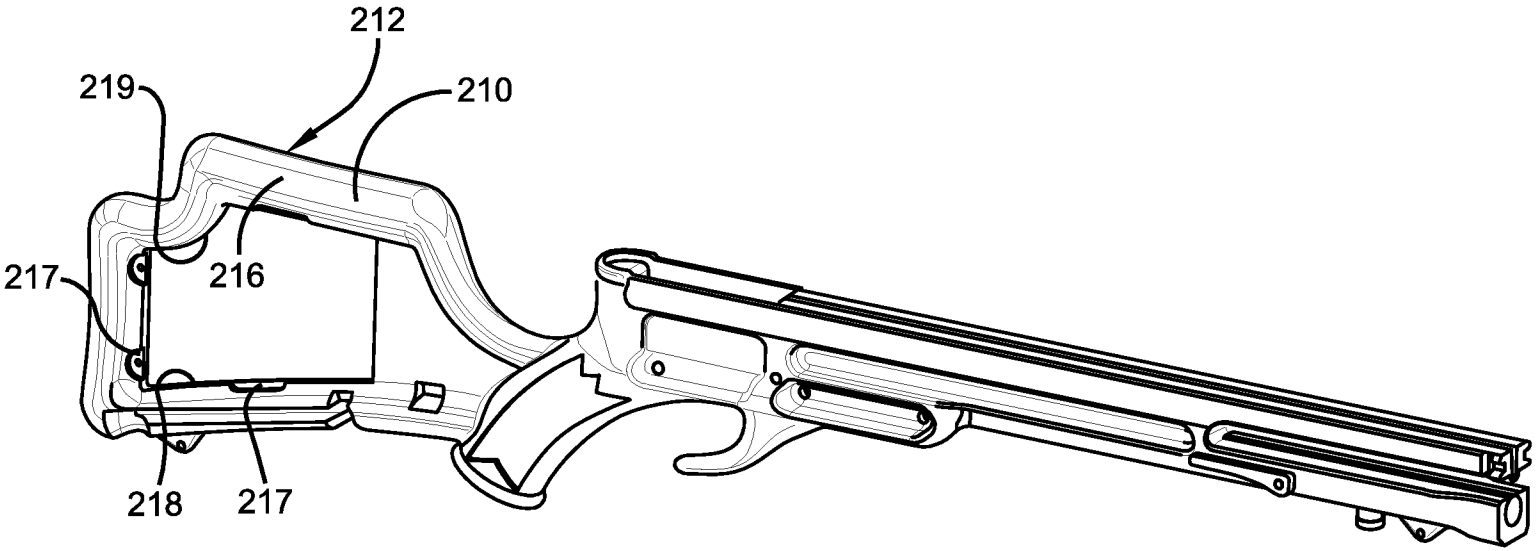
Figure 2B:
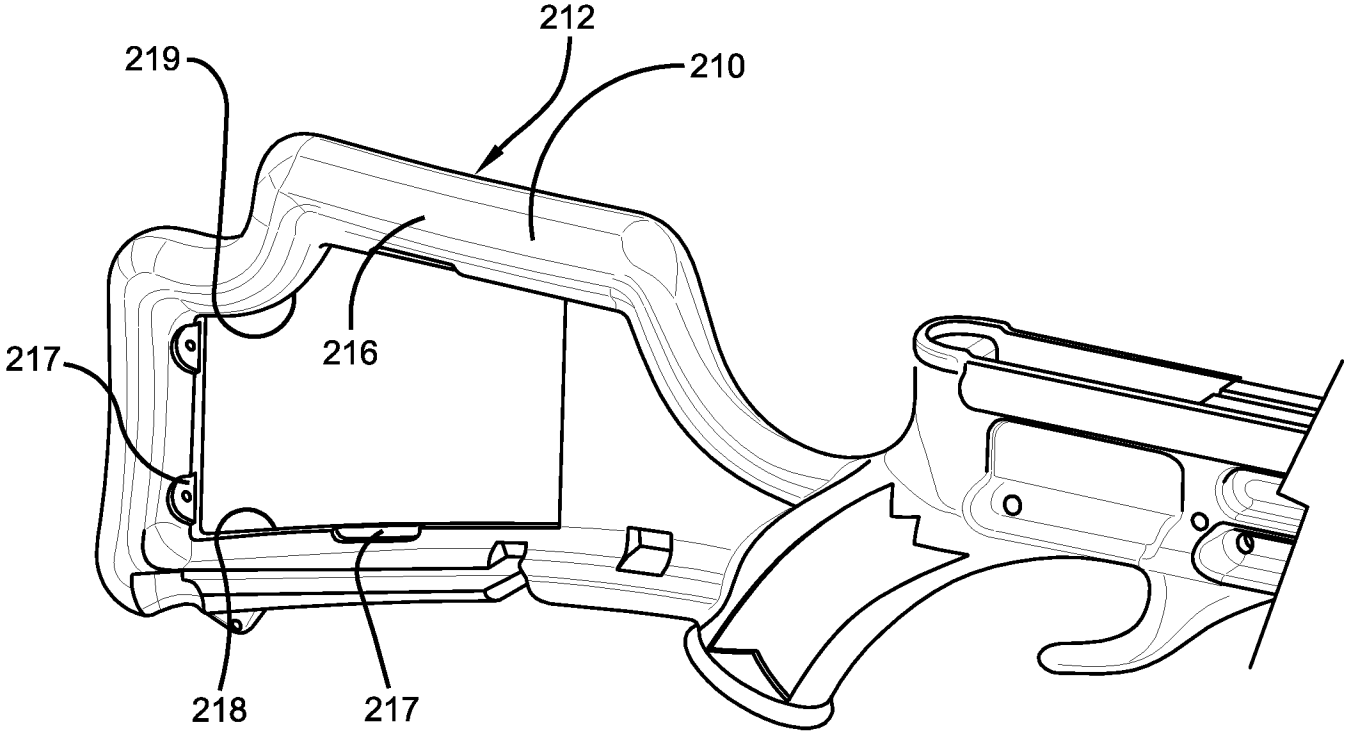
Figure 2C:
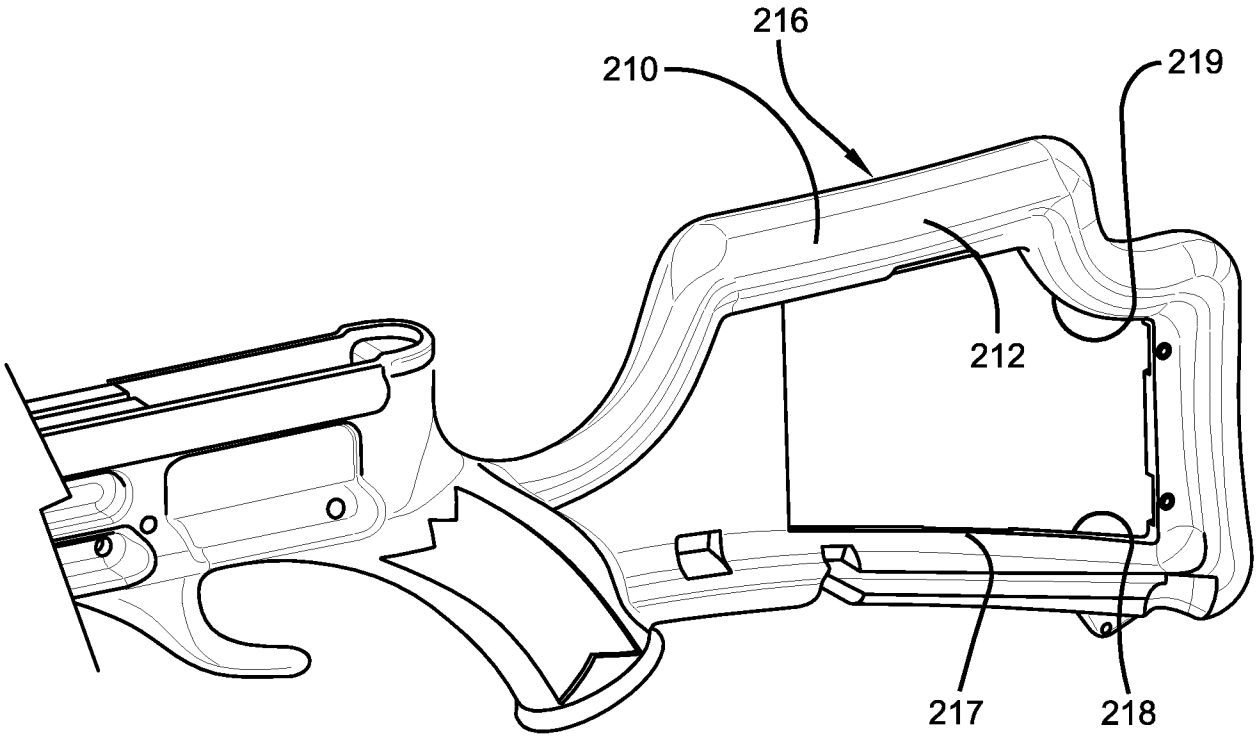

The crossbow stock 210 may have a first side 212 and a second side 216 opposite the first side 212. The crossbow stock 210 may comprise a first receptacle 218 defining a first receptacle perimeter 219. In the non-limiting embodiment shown in FIG. 2*a*-2*c*, first receptacle 218 is a through hole extending through the stock 210 from the first side 212 of the stock to the second side 216 of the stock. In other embodiments, the first receptacle 218 may be a blind hole extending from the first side 212 of the stock, or may be a blind hole extending from the second side 216 of the stock. In the non-limiting embodiment shown in FIGS. 2*a*-2*c*, the first receptacle perimeter 219 is adjacent to and in communication with a plurality of tab cavities 217. In other acceptable embodiments, there may be only one tab cavity 217. In the non-limiting embodiment shown in FIGS. 2*a*-2*c*, each tab cavity 217 is blind hole extending into the stock from either the first side 212 of the stock or the second side 216 of the stock. In certain embodiments the tab cavity 217 may extend into the stock 210 by half the width of the stock between the first side 212 and the second side 216. In other acceptable embodiments, the tab cavity 217 may extend into the stock 210 by between 10% and 90% of the width of the stock between the first side 212 and the second side 216. In some embodiments, all of the tab cavities 217 extend from the same side of the stock, either from the first side 212 or from the second side 216. In some embodiments, at least one tab cavity 217 extends from the first side 212 of the stock and at least one tab cavity 217 extends from the second side 216 of the stock.

An adapter plate 300, 400, 500 is adapted for selectable and operational engagement with a receptacle of a crossbow stock 210. By selectable engagement, it is meant than an associated user may readily engage or disengage the adapter plate 300, 400, 500 from the receptacle. By operational engagement it is meant that when engaged the adapter plate 300, 400, 500 is adapted to operate as described herein. In some embodiments, a plurality of adapter plates 300, 400, 500 may be adapted to engage with the receptacle 218 of the crossbow stock 210 in the alternative to one another such that the adapter plates 300, 400, 500 may be swapped out for one another, but only one installed in a single receptacle 218 at one time.

Figure 3A:
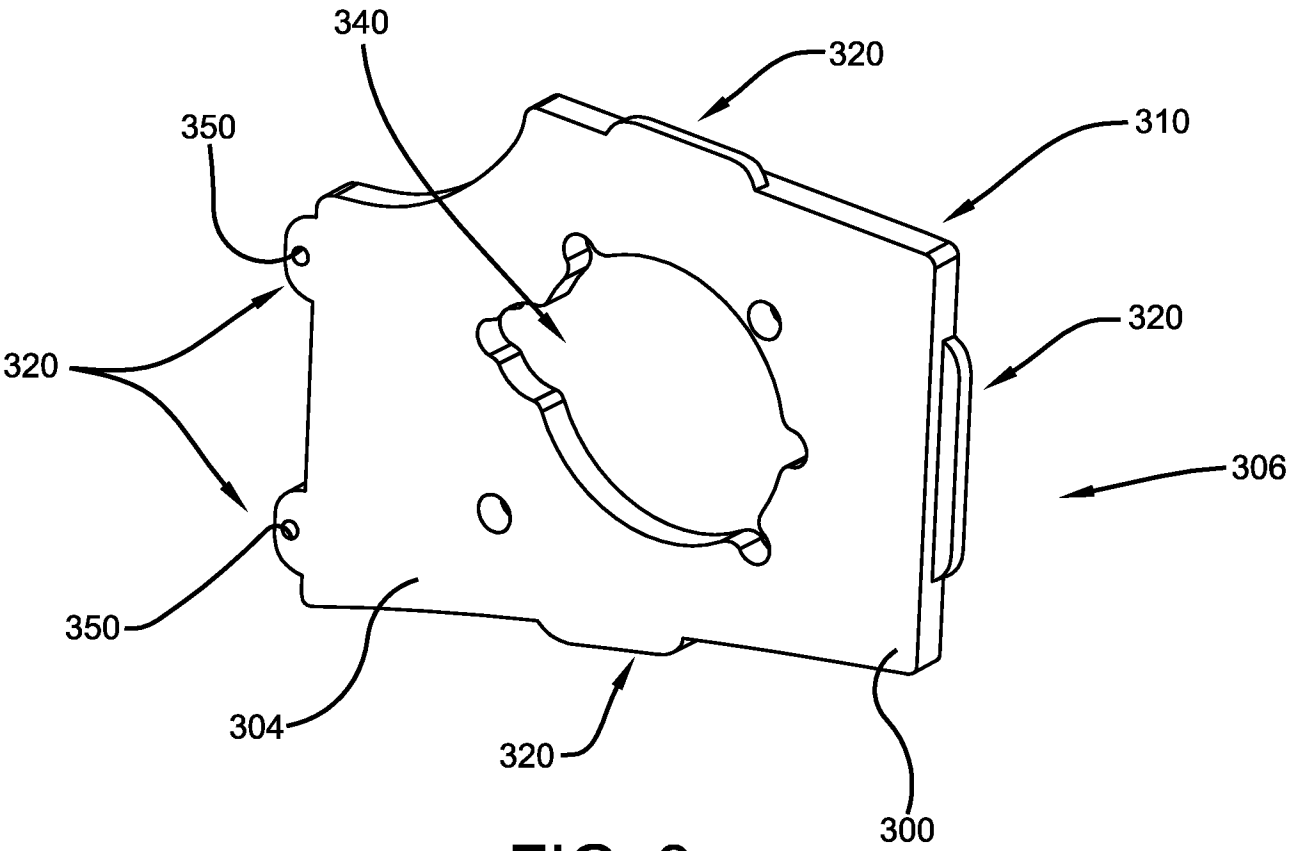
Figure 3B:
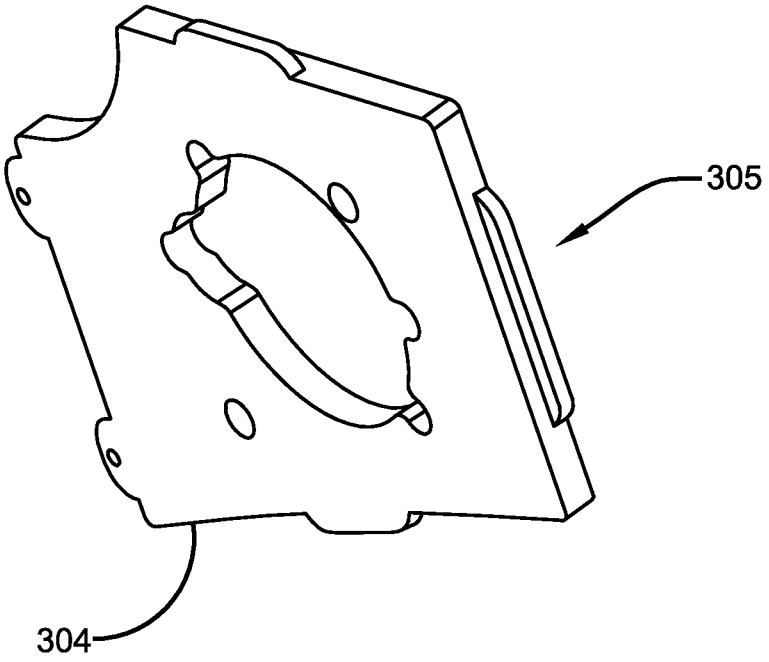
Figure 3C:
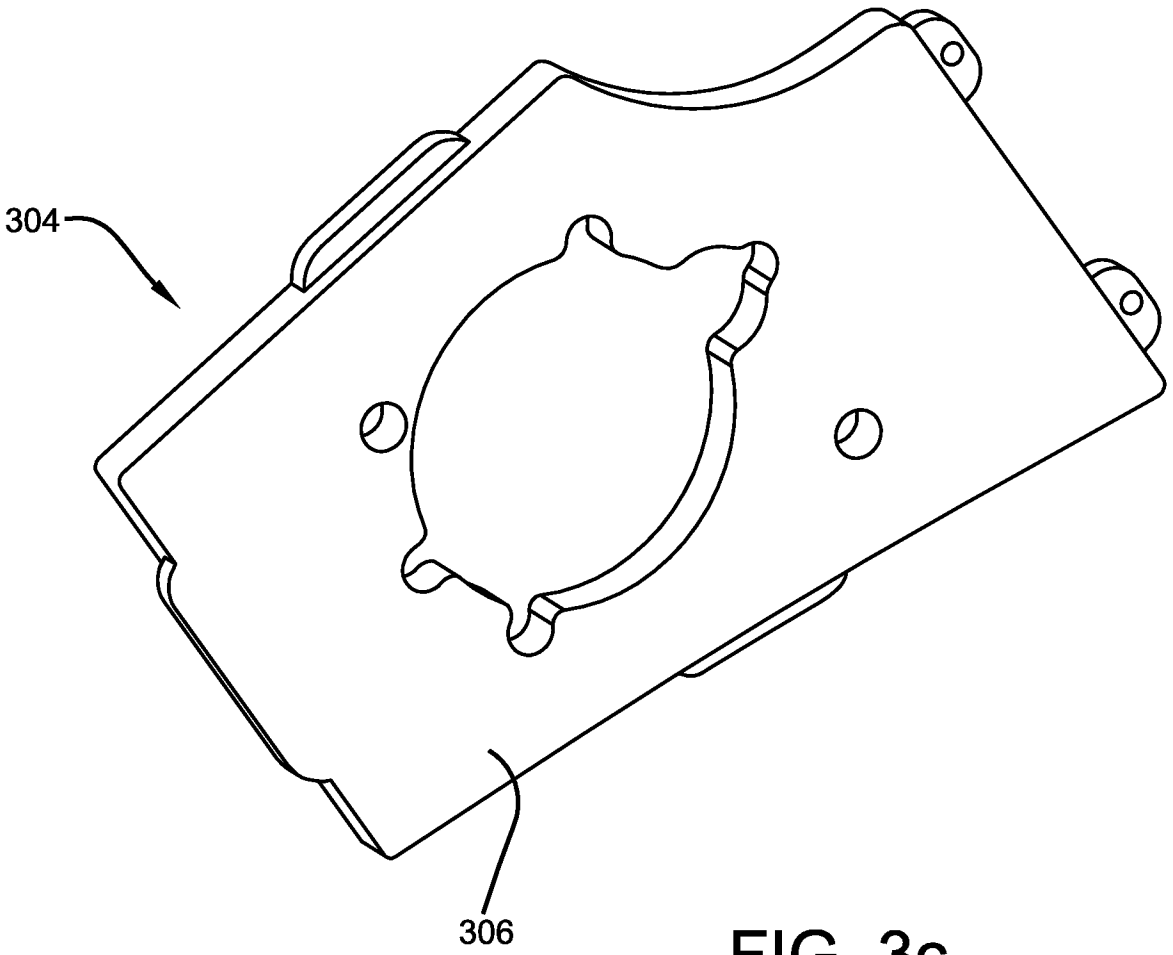

FIGS. 3*a*-3*c* show a first embodiment of an adapter plate 300. Adapter plate 300 is adapted for selectable and operational engagement with the first receptacle 218 of crossbow stock 210. The adapter plate 300 has a perimeter 310 that is substantially congruent with a perimeter 219 of the first receptacle 218 such that it fits therein, and may be installed therein, or removed therefrom by an associated user. In certain embodiments the adapter plate 300 may comprise one or more tabs 320. In certain embodiments the adapter plate 300 may comprise a plurality of tabs 320 arranged so that, when the adapter plate 300 is operationally engaged with the first receptacle 218, each tab 320 of the first plurality of tabs 320 engages with a tab cavity 217. The fit between the perimeter 219 of the first receptacle 218 and the perimeter 310 of the adapter plate 300 may be a locational transition fit or a locational clearance fit. Closer tolerances in the fit between the adapter plate 300 and the perimeter 219 promote secure fit and flow of mechanical stress within the assembly. A closer tolerance fit increases the loading to which the assembly may be safely and reliably subjected. Looser tolerance in the fit between the adapter plate 300 and the perimeter 219 promote ease of assembly, disassembly, interchangeability, and cost savings. Finding an appropriate compromise in the fit tolerancing is very desirable. In some embodiments, the fit between the perimeter 219 of the first receptacle 218 and the perimeter 310 of the adapter plate 300 may be compliant with any of the standards defined for a LC 1 through LC 11 fit or may be compliant with any of the standards defined for a LT 1 through LT 6 fit. In some embodiments, adapter plate 300 may comprise an adapter plate receptacle 340 therein. In some embodiments, adapter plate receptacle 340 may be a through hole.

Figure 4A:
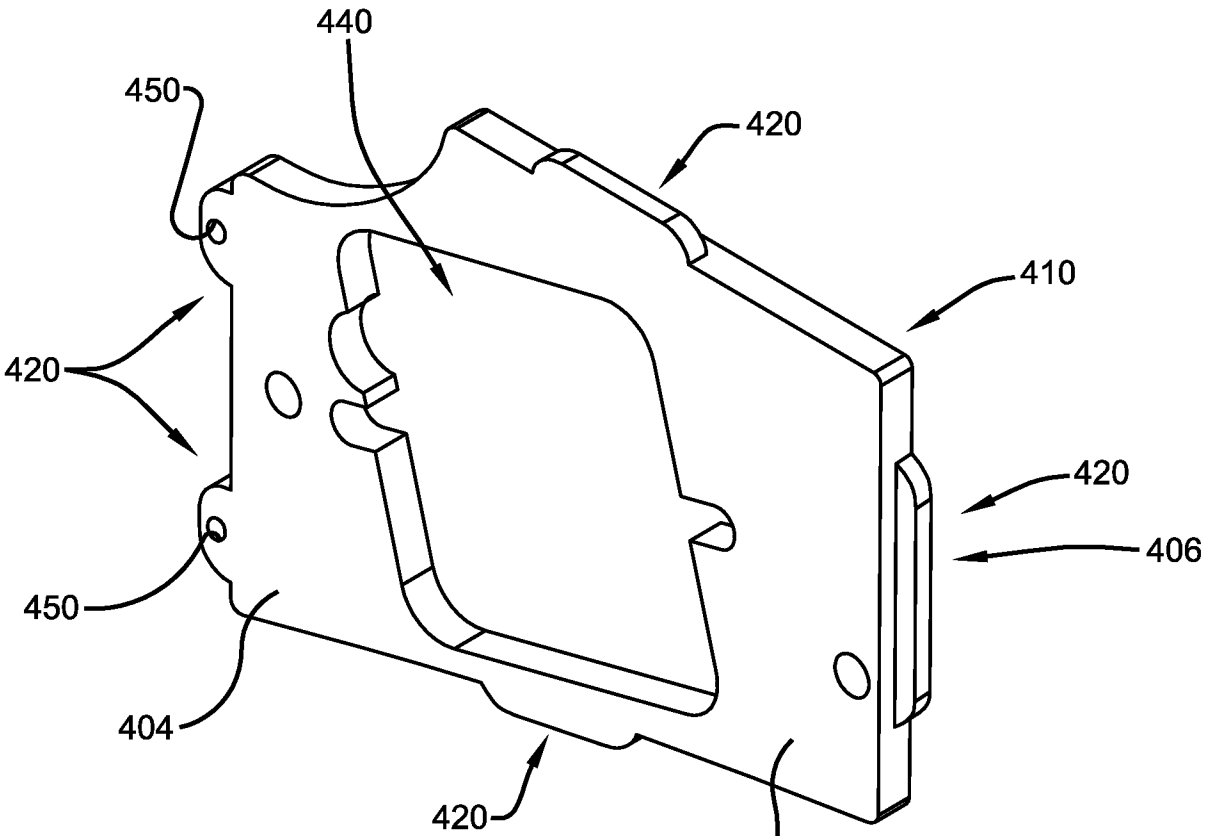
Figure 4B:
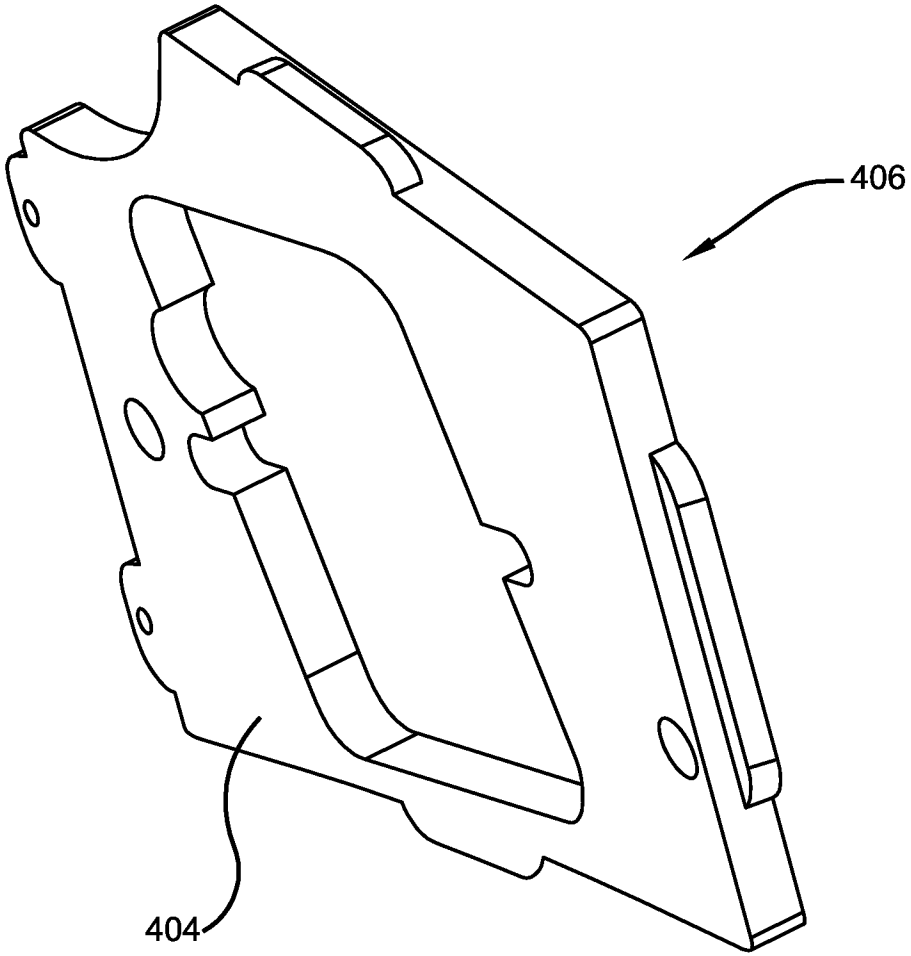
Figure 4C:
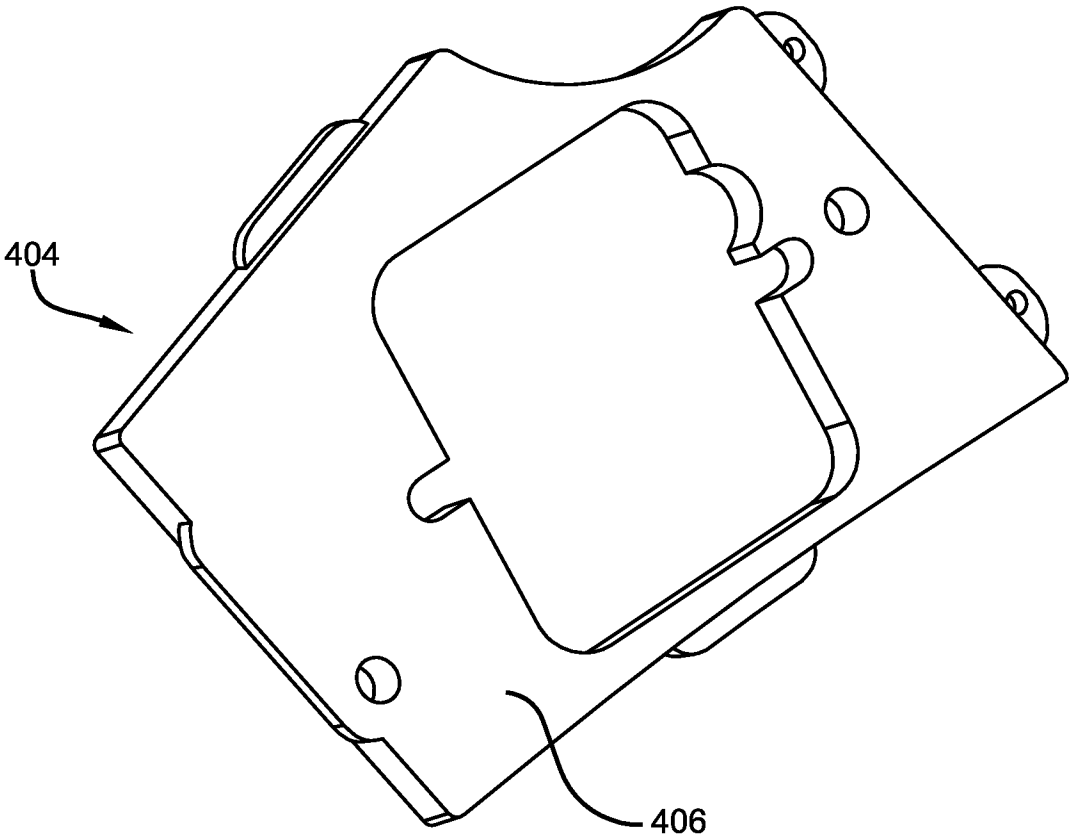

FIGS. 4*a*-4*c* show a second embodiment of an adapter plate 400. Adapter plate 400 is adapted for selectable and operational engagement with the first receptacle 218 of crossbow stock 210. The adapter plate 400 has a perimeter 410 that is substantially congruent with a perimeter 219 of the first receptacle 218 such that it fits therein, and may be installed therein, or removed therefrom by an associated user. In certain embodiments the adapter plate 400 may comprise one or more tabs 420. In certain embodiments the adapter plate 400 may comprise a plurality of tabs 420 arranged so that, when the adapter plate 400 is operationally engaged with the first receptacle 218, each tab 420 of the first plurality of tabs 420 engages with a tab cavity 217. The fit between the perimeter 219 of the first receptacle 218 and the perimeter 410 of the adapter plate 400 may be a locational transition fit or a locational clearance fit. Closer tolerances in the fit between the adapter plate 400 and the perimeter 219 promote secure fit and flow of mechanical stress within the assembly. A closer tolerance fit increases the loading to which the assembly may be safely and reliably subjected. Looser tolerance in the fit between the adapter plate 400 and the perimeter 219 promote ease of assembly, disassembly, interchangeability, and cost savings. Finding an appropriate compromise in the fit tolerancing is very desirable. In some embodiments, the fit between the perimeter 219 of the first receptacle 218 and the perimeter 410 of the adapter plate 400 may be compliant with any of the standards defined for a LC 1 through LC 11 fit or may be compliant with any of the standards defined for a LT 1 through LT 6 fit. In some embodiments, adapter plate 400 may comprise an adapter plate receptacle 440 therein. In some embodiments, adapter plate receptacle 440 may be a through hole.

Figure 5A:
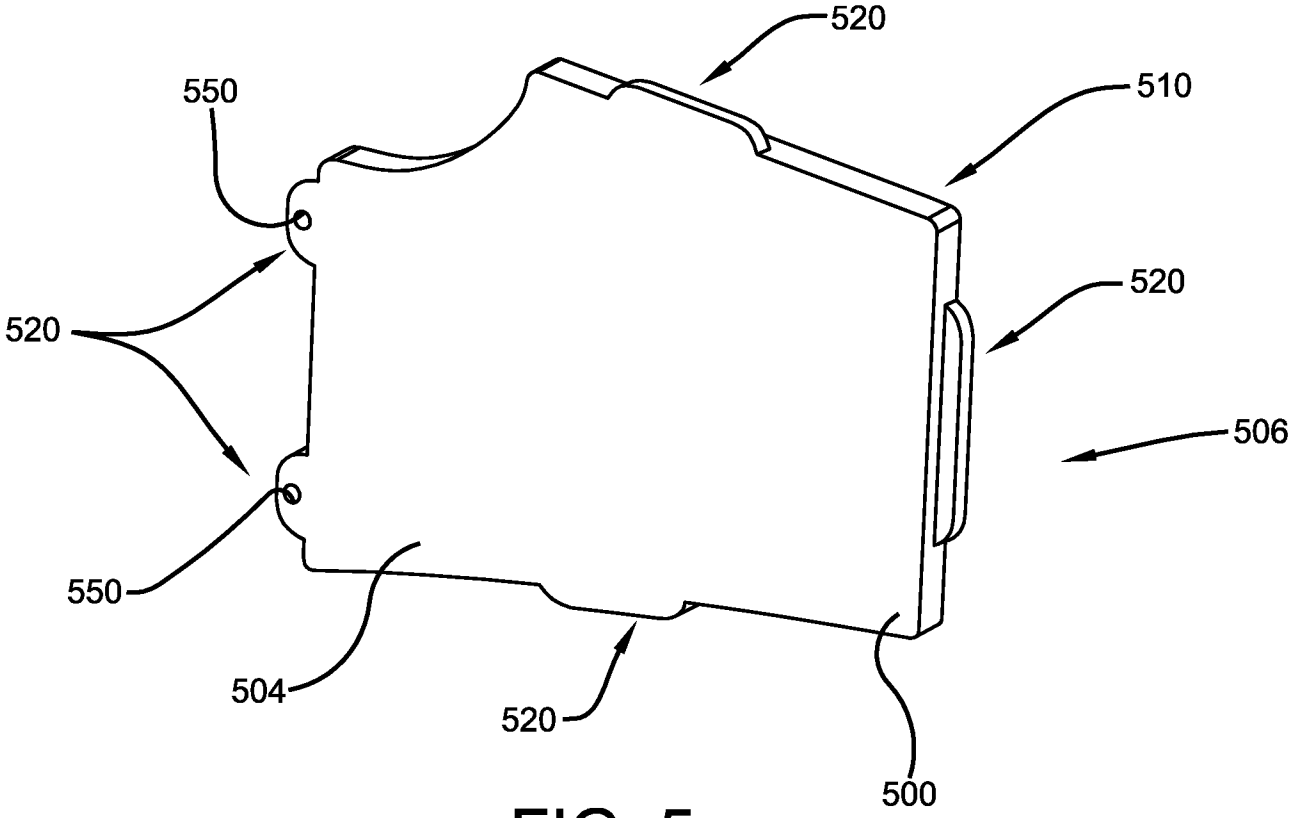
Figure 5B:
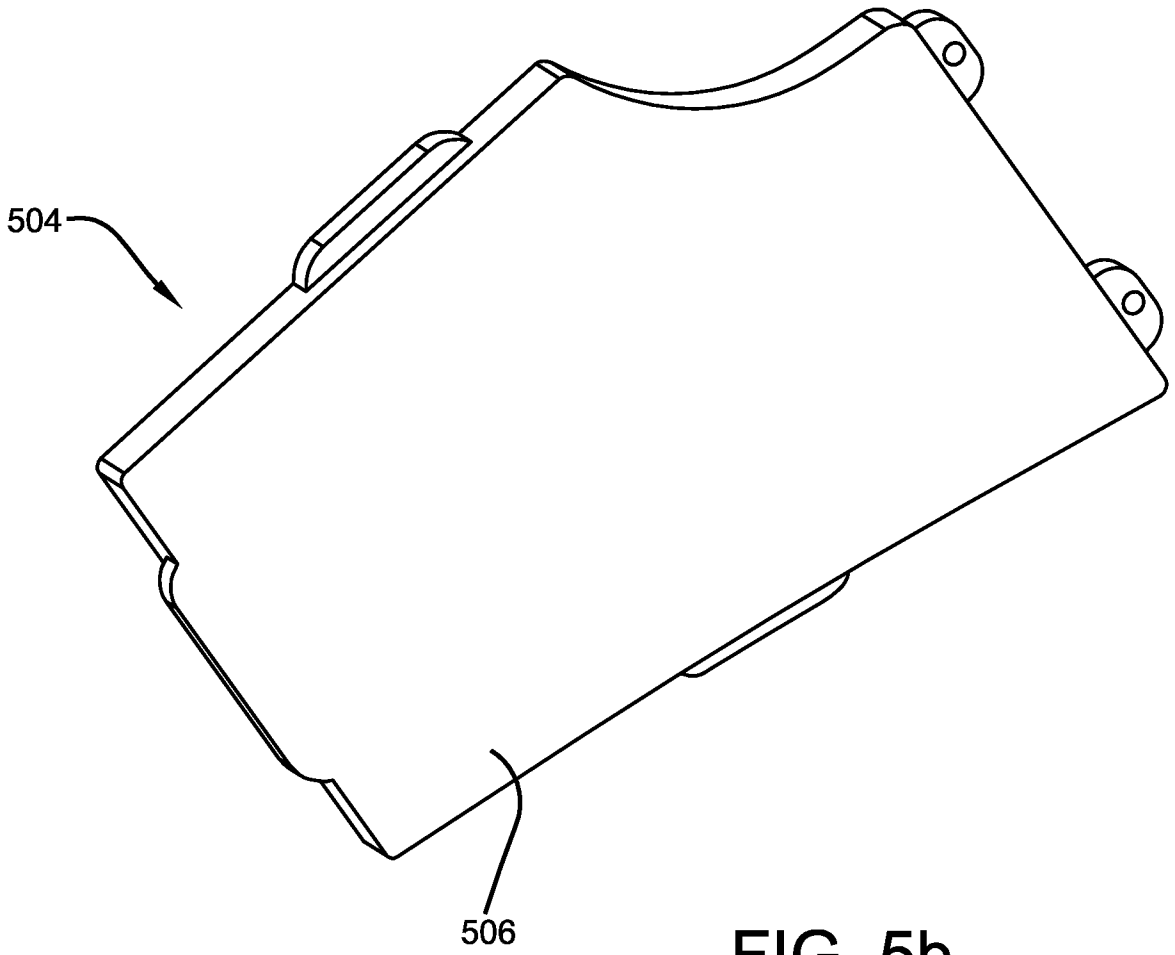
Figure 6:
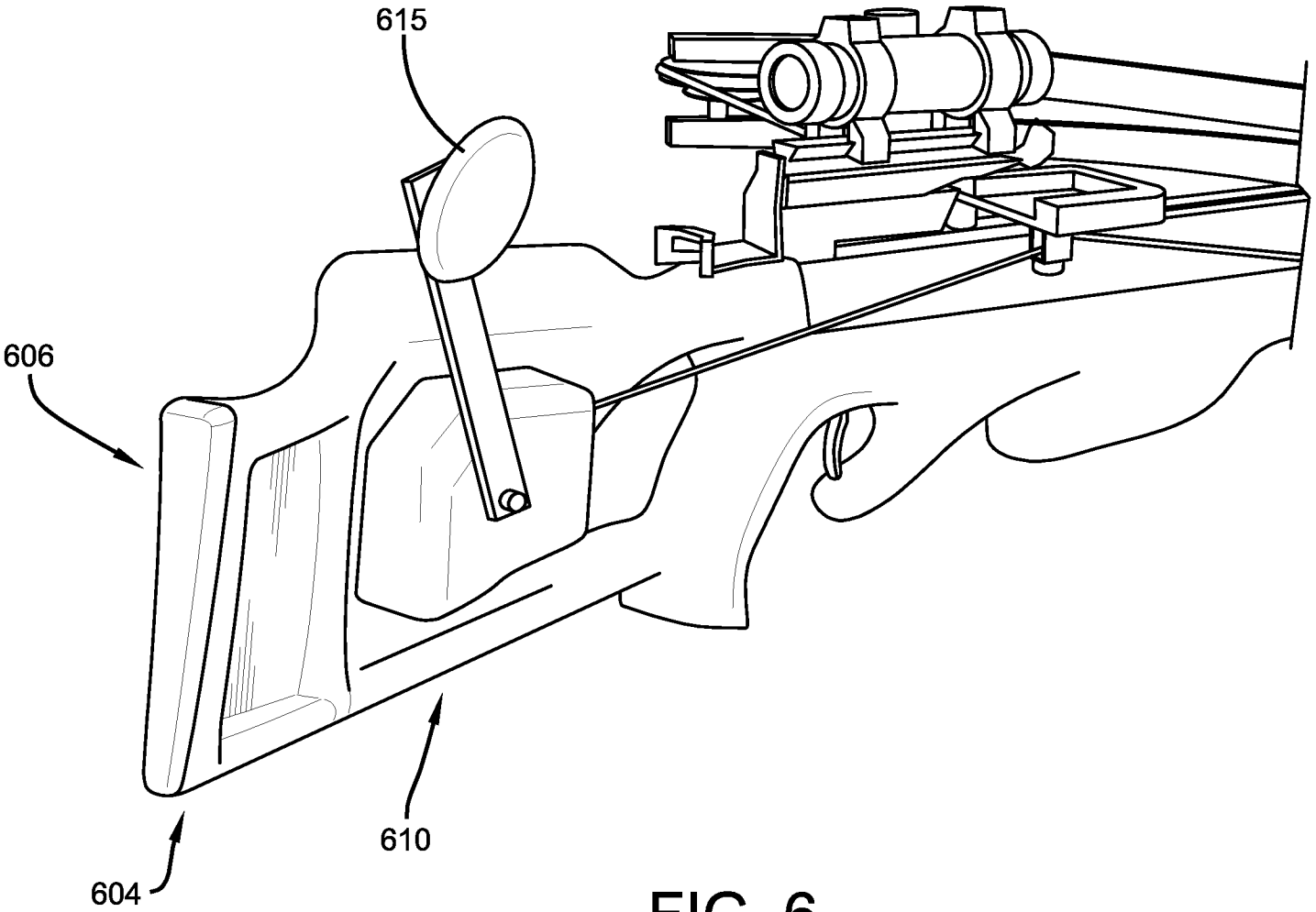
FIG. 6 is a perspective view of one embodiment of a cocking device installed in one embodiment of a crossbow stock.
Figure 7:
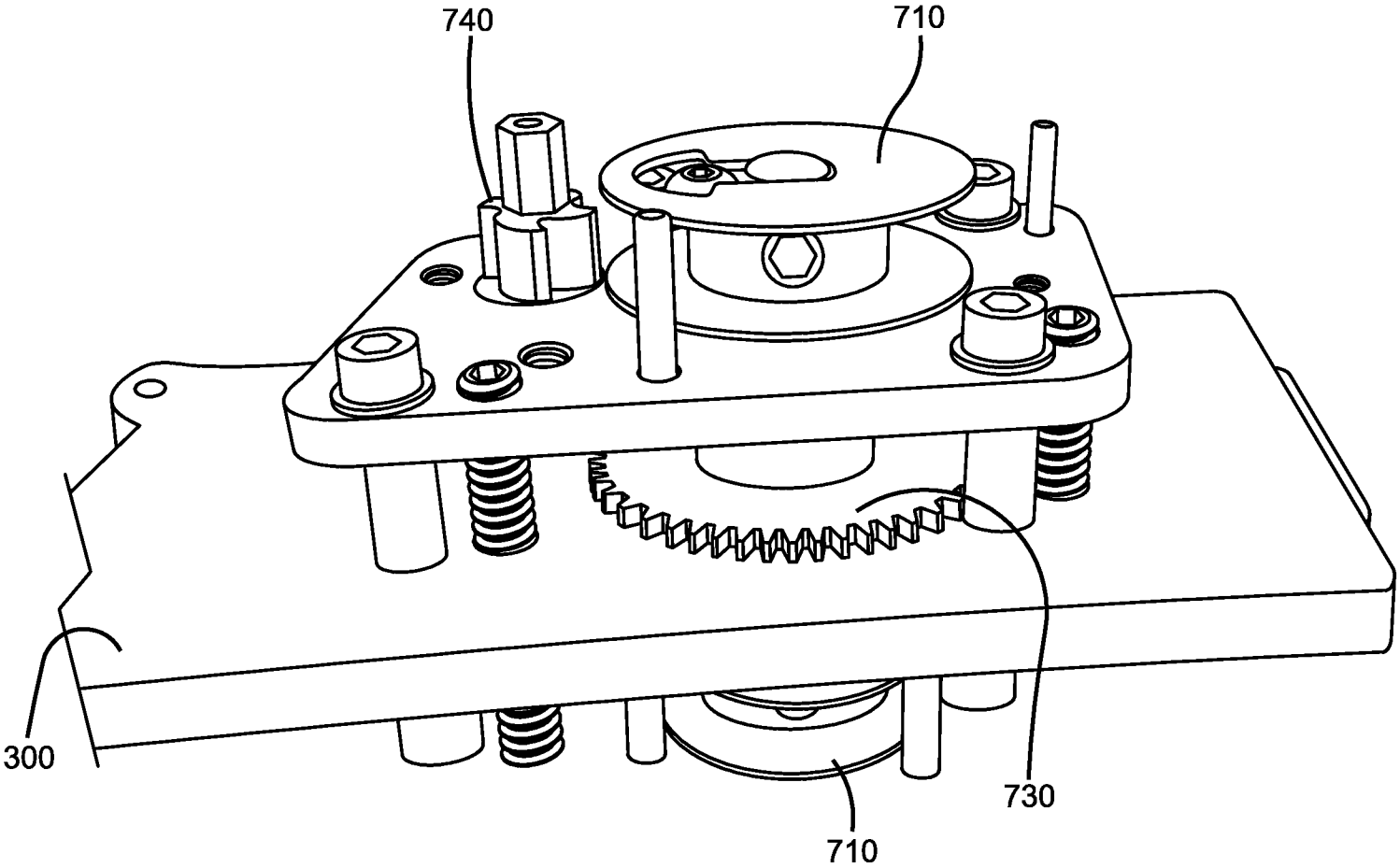
FIG. 7 is a view of one embodiment of the mechanisms of a cocking device.

FIGS. 5*a*-5*b* show a third embodiment of an adapter plate 500. Adapter plate 500 is adapted for selectable and operational engagement with the first receptacle 218 of crossbow stock 210. The adapter plate 500 has a perimeter 510 that is substantially congruent with a perimeter 219 of the first receptacle 218 such that it fits therein, and may be installed therein, or removed therefrom by an associated user. In certain embodiments the adapter plate 500 may comprise one or more tabs 520. In certain embodiments the adapter plate 500 may comprise a plurality of tabs 520 arranged so that, when the adapter plate 500 is operationally engaged with the first receptacle 218, each tab 520 of the first plurality of tabs 520 engages with a tab cavity 217. The fit between the perimeter 219 of the first receptacle 218 and the perimeter 510 of the adapter plate 500 may be a locational transition fit or a locational clearance fit. Closer tolerances in the fit between the adapter plate 500 and the perimeter 219 promote secure fit and flow of mechanical stress within the assembly. A closer tolerance fit increases the loading to which the assembly may be safely and reliably subjected. Looser tolerance in the fit between the adapter plate 500 and the perimeter 219 promote ease of assembly, disassembly, interchangeability, and cost savings. Finding an appropriate compromise in the fit tolerancing is very desirable. In some embodiments, the fit between the perimeter 219 of the first receptacle 218 and the perimeter 510 of the adapter plate 500 may be compliant with any of the standards defined for a LC 1 through LC 11 fit or may be compliant with any of the standards defined for a LT 1 through LT 6 fit.

An adapter plate 300, 400, 500 may optionally comprise one or more holes 350, 450, 550 adapted for operational engagement with a mechanical fastener that may, optionally act as a fastening means between the adapter plate 300, 400, 500 and a crossbow stock 210.

The method for using a crossbow cocking system comprises providing a crossbow cocking system 10. In some methods, the crossbow cocking system 10 may comprise a crossbow stock 210 having a first side 212 and a second side 216 opposite the first side 212, a first receptacle 218 extending through the stock 210 from the first side 212 of the stock to the second side 216 of the stock 210, a first adapter plate 300, 400, 500 adapted for selectable and operational engagement with the first receptacle 218, a cocking device 610 engaged with the first adapter plate 300, 400, 500, and extending through the first adapter plate 300, 400, 500, and a second adapter plate 300, 400, 500 adapted for selectable and operational engagement with the first receptacle 218 in the alternative with the first adapter plate 300, 400, 500. The method for using a crossbow cocking system 10 may further comprise either: 1) engaging the first adapter plate 300, 400, 500 with the first receptacle 218, disengaging the first adapter plate 300, 400, 500 from the first receptacle 218, and engaging the second adapter plate 300, 400, 500 with the first receptacle 218; or 2) engaging the second adapter plate 300, 400, 500 with the first receptacle 218, disengaging the second adapter plate from the first receptacle, and engaging the first adapter plate with the first receptacle.

In some embodiments of the method for using a crossbow cocking system 10, the first adapter plate 300, 400, 500 is adapted for transition fit with the first receptacle 218, and the second adapter plate 300, 400, 500 is adapted for transition fit with the first receptacle 218. In some embodiments of the method for using a crossbow cocking system 10, the first adapter plate 300, 400, 500 has a perimeter 219 and the first receptacle perimeter 219 is adjacent to and in communication with a first plurality of tab cavities 217. In some embodiments of the method for using a crossbow cocking system 10, at least one tab cavity 217 is a blind hole extending from the first side 212 of the stock 210, and at least one tab cavity 217 is a blind hole extending from the second side 216 of the stock 210. In some embodiments of the method for using a crossbow cocking system 10, the first adapter plate 300, 400, 500 has a first plurality of tabs 320, 420, 520 and the second adapter plate 300, 400, 500 has a second plurality of tabs 320, 420, 520. In some embodiments the method for using a crossbow cocking system 10, further comprises either 1) operationally engaging each tab 320, 420, 520 of the first plurality of tabs 320, 420, 520 with a tab cavity 217, and operationally disengaging each tab 320, 420, 520 of the first plurality of tabs 320, 420, 520 from a tab cavity 217, and operationally engaging each tab 320, 420, 520 of the second plurality of tabs 320, 420, 520 with a tab cavity 217; or 2) operationally engaging each tab 320, 420, 520 of the second plurality of tabs 320, 420, 520 with a tab cavity 217 and operationally disengaging each tab 320, 420, 520 of the second plurality of tabs 320, 420, 520 from a tab cavity 217, and operationally engaging each tab 320, 420, 520 of the first plurality of tabs 320, 420, 520 with a tab cavity 217.

The present subject matter may include a crossbow 100. This latter crossbow 100 may comprise a stock 210, the stock 210 having a first side 212, and a second side 216 opposite the first side 212 the stock 210 defining a first receptacle 218 therein, the first receptacle 218 defining a first receptacle perimeter 219; a plurality of adapter plates 300, 400, 500 with each adapter plate 300, 400, 500 adapted being selectably and operationally engageable with the first receptacle 218 in the alternative to each other adapter plate 300, 400, 500; and a cocking device 610 engaged with at least one adapter plate 300, 400, 500, the cocking device 610 extending through the adapter plate 300, 400, 500 with which it is engaged, and being usable to safely perform a cocking operation. Some embodiments of this latter crossbow 100 may further comprise a bowstring 110 adapted to be moved between an uncocked position 112 and a cocked position 114 by the cocking operation, and a plurality of tab cavities 217; wherein the first receptacle 218 has a through hole in communication with the first side 212 of the stock 210 and the second side 216 of the stock 210, and each tab cavity 217 is a blind hole open to the first receptacle 218 and either the first side 212 of the stock 210, or the second side 216 of the stock 210, and adapted for operational engagement with a tab 320, 420, 520.

In some embodiments of this latter crossbow 100, the plurality of adapter plates 300, 400, 500, may have a first adapter plate 300, 400, 500 having a first side of the first adapter plate 304, 404, 504, and a second side of the first adapter plate 306, 406, 506 opposite the first side 304, 404, 504 of the first adapter plate 300, 400, 500, a first adapter plate perimeter 310, 410, 510 adapted for transition fit with the first receptacle perimeter 219, and a plurality of tabs 320, 420, 520 wherein each tab 320, 420, 520 is adapted for operational engagement with at least one of the tab cavities 217 by insertion therein. In some embodiments of this latter crossbow 100 the plurality of adapter plates 300, 400, 500 may have a second adapter plate 300, 400 having, a first side 304, 404 of the second adapter plate 300, 400 and a second side 306, 406 of the second adapter plate 300, 400 opposite the first side 304, 404 of the second adapter plate 300, 400, a second adapter plate perimeter 310, 410 adapted for transition fit with the first receptacle perimeter 219, a plurality of tabs 320, 420 wherein each tab 320, 420 is adapted for operational engagement with at least one of the tab cavities 217 by insertion therein, and defining therein a second receptacle 340, 440, the second receptacle 340, 440 being a through hole in communication with the first side 304, 404 of the second adapter plate 300, 400 and the second side 306, 406 of the second adapter plate 300, 400.

According to some embodiments, a crossbow 10 may comprise a bowstring 110 adapted to be moved between an uncocked position 112 and a cocked position 114 by a cocking operation. A cocking operation subjects the bowstring 110 to some draw force 117 and moves the bowstring over some draw length 116 where the draw length 116 is the distance along from the uncocked position 112 and a cocked position 114 along which the draw force 117 is applied. In some embodiments, the draw force 117 is applied along, or very close to, the beam 105 of the crossbow 10. In some embodiments the draw force 117 increases with distance over at least part of the path of the bowstring 110 as the bowstring 110 is drawn from the uncocked position 112 to the cocked position 114. In some embodiments, the cocking operation requires a maximum draw force 117 of between 80 pounds and 200 pounds. The energy stored in the crossbow by the cocking operation may be between 500 foot-pounds and 3000 foot-pounds.

According to some embodiments, a crossbow 10 may comprise a bowstring 110 adapted to be moved between an uncocked position 112 and a cocked position 114 by a cocking operation; a stock; and a plurality of adapter plates. The cocking operation may require a maximum draw force 117 of at least 150 pounds, and store at least 2000 foot-pounds of energy in the crossbow 100.

The stock 210 may have a first side 212 of the stock 210 and a second side 216 of the stock 210 opposite the first side 212 of the stock 210, the stock 210 defining a first receptacle 218 therein, the first receptacle 218 having a through hole in communication with the first side 212 of the stock and the second side 216 of the stock 210, defining a first receptacle perimeter 219, a plurality of tab cavities 217 wherein each tab cavity 217 is a blind hole open to the first receptacle 218 and either the first side 212 of the stock 210, or the second side 216 of the stock 210, adapted for operational engagement with a tab 320, 420, 520, and wherein at least one tab cavity 217 is open to the first side 212 of the stock 210, and at least one tab cavity 217 is open to the second side 216 of the stock 210.

In the plurality of adapter plates 300, 400, 500 each adapter plate 300, 400, 500 may be adapted to be selectably and operationally engageable with the first receptacle 218 in the alternative to each other adapter plate 300, 400, 500. The plurality of adapter plates 300, 400, 500 may comprise a first adapter plate 300, 400 and a second adapter plate 300, 400.

The first adapter plate 300, 400 may have a first side 304, 404 of the first adapter plate 300, 400, and a second side 306, 406 of the first adapter plate 300, 400 opposite the first side

304, 404 of the first adapter plate 300, 400, a first adapter plate perimeter 310, 410 substantially congruent with the first receptacle perimeter 219, a first set of tabs 320, 420 defined by a plurality of tabs 320, 420 wherein each tab 320, 420 is adapted for operational engagement with at least one of the tab cavities 217 by insertion therein, defining therein a second receptacle 340, 440, the second receptacle 340, 440 being a through hole in communication with the first side 304, 404 of the first adapter plate 300, 400 and the second side 306, 406 of the first adapter plate 300, 400, and having a cocking device 610 operationally engaged with the second receptacle 340, 440, the cocking device 610 comprising at least two pulleys 710 driven by a gear assembly 730 driven by a hand-crank 615 on the right hand side 604 of the cocking device 610 when operationally engaged with the crossbow 100, extending through the second receptacle 340, 440, and being useable to perform the cocking operation The second adapter plate 300, 400 may have a first side 304, 404, of the second adapter plate, 300, 400, and a second side 306, 406 of the second adapter plate 300, 400 opposite the first side 304, 404 of the second adapter plate 300, 400, a second adapter plate perimeter 310, 410 substantially congruent with the first receptacle perimeter 219, a second set of tabs 320, 420 defined by a plurality of tabs 320, 420 wherein each tab 320, 420 is adapted for operational engagement with at least one of the tab cavities 217 by insertion therein, and defining therein a third receptacle 340, 440, the third receptacle 340, 440 being a through hole in communication with the first side 304, 404 of the second adapter plate 300, 400 and the second side 306, 406 of the second adapter plate 300, 400, and having a cocking device 610 operationally engaged with the third receptacle 340, 440, the cocking device 610 comprising at least two pulleys 710 driven by a gear assembly 730 driven by a hand-crank 615 on the left hand side 606 of the cocking device 610 when operationally engaged with the crossbow 100, extending through the third receptacle 340, 440, and being useable to perform the cocking operation.

The cocking device 610 may comprise one or more components or mechanisms engageable therewith and adapted to operate to prevent the cocking device from being driven in reverse. The cocking device 610 may optionally comprise a ratchet 740 or other component adapted to be lockable for one-way rotation, for example and not by way of limitation, by a pawl. The cocking device 610 may optionally drive a pulley with a worm drive in the alternative to or in addition to the gear assembly 730. In some embodiments a worm drive may be self-locking.

Further examples consistent with the present subject matter are set out in the following numbered clauses.

Clause 1. A crossbow cocking system comprising a crossbow stock having a first side and a second side opposite the first side a first receptacle extending through the stock from the first side of the stock to the second side of the stock; a first adapter plate adapted for selectable and operational engagement with the first receptacle; and a cocking device engaged with the first adapter plate, and extending through the first adapter plate.

Clause 2. A method for using a crossbow cocking system comprising providing a crossbow cocking system having a crossbow stock having a first side and a second side opposite the first side, a first receptacle extending through the stock from the first side of the stock to the second side of the stock, a first adapter plate adapted for selectable and operational engagement with the first receptacle, a cocking device engaged with the first adapter plate, and extending through the first adapter plate, and a second adapter plate adapted for selectable and operational engagement with the first receptacle in the alternative with the first adapter plate; and either, 1) engaging the first adapter plate with the first receptacle, disengaging the first adapter plate from the first receptacle, and engaging the second adapter plate with the first receptacle, or 2) engaging the second adapter plate with the first receptacle, disengaging the second adapter plate from the first receptacle, and engaging the first adapter plate with the first receptacle.

Clause 3. A crossbow comprising a bowstring adapted to be moved between an uncocked position and a cocked position by a cocking operation, the cocking operation requiring a maximum draw force of at least 150 pounds, and storing at least 2000 foot pounds of energy in the crossbow; a stock the stock having a first side of the stock and a second side of the stock opposite the first side of the stock, the stock defining a first stock receptacle therein, the first stock receptacle having a through hole in communication with the first side of the stock and the second side of the stock, defining a first stock receptacle perimeter, a plurality of tab cavities wherein each tab cavity is a blind hole open to the first stock receptacle and either the first side of the stock, or the second side of the stock, adapted for operational engagement with a tab, and wherein at least one tab cavity is open to the first side of the stock, and at least one tab cavity is open to the second side of the stock; a plurality of adapter plates wherein each adapter plate is adapted to be selectably and operationally engageable with the first stock receptacle in the alternative to each other adapter plate, having a first adapter plate, having a first side of the first adapter plate, and a second side of the first adapter plate opposite the first side of the first adapter plate, a first adapter plate perimeter substantially congruent with the first stock receptacle perimeter, a first set of tabs defined by a plurality of tabs wherein each tab is adapted for operational engagement with at least one of the tab cavities by insertion therein, defining therein a second receptacle, the second receptacle being a through hole in communication with the first side of the first adapter plate and the second side of the first adapter plate, and having a cocking device operationally engaged with the second receptacle, the cocking device comprising at least two pulleys driven by a gear assembly driven by a hand-crank on the right hand side of the cocking device when operationally engaged with the crossbow, extending through the second receptacle, and being useable to perform the cocking operation; having a second adapter plate, having a first side of the second adapter plate, and a second side of the second adapter plate opposite the first side of the second adapter plate, a second adapter plate perimeter substantially congruent with the first stock receptacle perimeter, a second set of tabs defined by a plurality of tabs wherein each tab is adapted for operational engagement with at least one of the tab cavities by insertion therein, and defining therein a third receptacle, the third receptacle being a through hole in communication with the first side of the second adapter plate and the second side of the second adapter plate, and having a cocking device operationally engaged with the third receptacle, the cocking device comprising at least two pulleys driven by a gear assembly driven by a hand-crank on the left hand side of the cocking device when operationally engaged with the crossbow, extending through the third receptacle, and being useable to perform the cocking operation.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

We claim:

1. A crossbow cocking system comprising:

a crossbow stock having a first side and a second side opposite the first side;

a receptacle extending through the stock from the first side of the stock to the second side of the stock;

a first adapter plate adapted to be attached to the crossbow stock; and a cocking device that: (1) engages the first adapter plate, and (2) extends through the first adapter plate;

wherein:

(1) one of the receptacle and the first adapter plate has a first tab cavity; and (2) the other of the receptacle and the first adapter plate has a first tab that engages the first tab cavity when the first adapter plate is attached to the crossbow stock.

2. The crossbow cocking system of claim 1 further comprising:

a second adapter plate adapted to be attached to the crossbow stock in place of the first adapter plate;

wherein one of:

(1) the receptacle has the first tab cavity and the second adapter plate has a tab defined as a second tab that engages the first tab cavity when the second adapter plate is attached to the crossbow stock; and (2) the receptacle has the first tab and the second adapter plate has a tab cavity defined as a second tab cavity that engages the first tab when the second adapter plate is attached to the crossbow stock.

3. The crossbow cocking system of claim 1 wherein:

one of the receptacle and the first adapter plate has a second tab cavity; and the other of the receptacle and the first adapter plate has a second tab that engages the second tab cavity when the first adapter plate is attached to the crossbow stock.

4. The crossbow cocking system of claim 1 wherein:

the first adapter plate has a perimeter that is substantially congruent with a perimeter of the receptacle;

one of the receptacle perimeter and the first adapter plate perimeter has the first tab cavity; and the other of the receptacle perimeter and the first adapter plate perimeter has the first tab.

5. The crossbow cocking system of claim 1 wherein:

the receptacle is a through hole.

6. The crossbow cocking system of claim 1 wherein:

the first adapter plate is adapted for a transition fit with the receptacle.

7. The crossbow cocking system of claim 1 wherein:

the first adapter plate is positioned within the receptacle when it is attached to the crossbow stock.

8. The crossbow cocking system of claim 1 wherein:

the receptacle has the first tab cavity; and the first tab cavity is a blind hole extending into the stock from either the first side of the stock or the second side of the stock.

9. A crossbow comprising:

a crossbow stock having a first side and a second side opposite the first side;

a bowstring supported to the crossbow stock and adapted to be moved between an uncocked position and a cocked position by a cocking operation;

a receptacle extending through the stock from the first side of the stock to the second side of the stock;

a first adapter plate adapted to be attached to the crossbow stock; and a cocking device that: (1) engages the first adapter plate; and (2) is operable to move the bowstring from the uncocked position to the cocked position when the first adapter plate is attached to the crossbow stock;

wherein:

(1) one of the receptacle and the first adapter plate has a first tab cavity;

(2) the other of the receptacle and the first adapter plate has a first tab that engages the first tab cavity when the first adapter plate is attached to the crossbow stock;

(3) one of the receptacle and the first adapter plate has a second tab cavity; and (4) the other of the receptacle and the first adapter plate has a second tab that engages the second tab cavity when the first adapter plate is attached to the crossbow stock.

10. The crossbow of claim 9 further comprising:

a second adapter plate adapted to be attached to the crossbow stock in place of the first adapter plate and adapted to engage the cocking device.

11. The crossbow of claim 9 further comprising:

a second adapter plate adapted to be attached to the crossbow stock in place of the first adapter plate and not adapted to engage the cocking device.

12. The crossbow of claim 9 wherein:

the first adapter plate has a perimeter that is substantially congruent with a perimeter of the receptacle;

one of the receptacle perimeter and the first adapter plate perimeter has the first tab cavity;

the other of the receptacle perimeter and the first adapter plate perimeter has the first tab;

one of the receptacle perimeter and the first adapter plate perimeter has the second tab cavity; and the other of the receptacle perimeter and the first adapter plate perimeter has the second tab.

13. The crossbow of claim 9 wherein:

the receptacle is a through hole.

14. The crossbow of claim 9 wherein:

the first adapter plate is adapted for a transition fit with the receptacle.

15. The crossbow of claim 9 wherein:

the first adapter plate is positioned within the receptacle when it is attached to the crossbow stock.

16. The crossbow of claim 9 wherein:

the receptacle has the first and second tab cavities; and each of the first and second tab cavities is a blind hole extending into the stock from either the first side of the stock or the second side of the stock.

17. A crossbow cocking method comprising the steps of:

(A) providing a crossbow including: (1) a crossbow stock having a first side and a second side opposite the first side; (2) a bowstring supported to the crossbow stock and adapted to be moved between an uncocked position and a cocked position by a cocking operation; (3) a receptacle extending through the stock from the first side of the stock to the second side of the stock; (4) a first adapter plate; and (5) a cocking device;

(B) providing one of the receptacle and the first adapter plate with a first tab cavity;

(C) providing the other of the receptacle and the first adapter plate with a first tab;

(D) providing the bowstring to be cockable using these steps:

(1) engaging the first tab to the first tab cavity to attach the first adapter plate to the crossbow stock;

(2) attaching the cocking device to the first adapter plate; and (3) operating the cocking device to move the bowstring from the uncocked position to the cocked position.

18. The crossbow cocking method of claim 17 wherein:

step (A) comprises providing the crossbow with a second adapter plate; and step (D) further comprises the steps of:

(4) one of: (a) providing the receptacle with the first tab cavity and providing the second adapter plate with a tab defined as a second tab; and (b) providing the receptacle with the first tab and providing the second adapter plate with a tab cavity defined as a second tab cavity;

(5) detaching the first adapter plate from the crossbow stock;

(6) detaching the cocking device from the first adapter plate;

(7) attaching the second adapter plate to the crossbow stock in place of the first adapter plate by one of: (a) engaging the second tab to the first tab cavity; and (b) engaging the first tab to the second tab cavity;

(8) attaching the cocking device to the second adapter plate; and (9) operating the cocking device to move the bowstring from the uncocked position to the cocked position.

19. The crossbow cocking method of claim 17 wherein:

step (A) comprises the steps of: providing the receptacle with a perimeter; and providing the first adaptor plate with a perimeter that is substantially congruent with the receptacle perimeter;

step (B) comprises providing one of the receptacle perimeter and the first adapter plate perimeter with the first tab cavity;

step (C) comprises providing the other of the receptacle perimeter and the first adapter plate perimeter with the first tab;

the method further comprises the steps of: providing one of the receptacle perimeter and the first adapter plate perimeter with a second tab cavity; and providing the other of the receptacle perimeter and the first adapter plate perimeter with a second tab; and step (D) further comprises the step of: engaging the second tab to the second tab cavity to attach the first adapter plate to the crossbow stock.

20. The crossbow cocking method of claim 17 wherein:

step (A) comprises providing the crossbow with a second adapter plate that is not adapted to attach to the cocking device; and providing the bowstring to be uncockable via the cocking device using these steps:

(1) one of: (a) providing the receptacle with the first tab cavity and providing the second adapter plate with a tab defined as a second tab; and (b) providing the receptacle with the first tab and providing the second adapter plate with a tab cavity defined as a second tab cavity;

(2) detaching the first adapter plate from the crossbow stock; and (3) attaching the second adapter plate to the crossbow stock in place of the first adapter plate by one of: (a) engaging the second tab to the first tab cavity; and (b) engaging the first tab to the second tab cavity.

* * * * *